US009799263B2

(12) United States Patent
Zhang et al.

(10) Patent No.: US 9,799,263 B2
(45) Date of Patent: Oct. 24, 2017

(54) POWER SUPPLY CIRCUIT AND ORGANIC LIGHT-EMITTING DIODE DISPLAY DEVICE

(71) Applicants: BOE TECHNOLOGY GROUP CO., LTD., Beijing (CN); ORDOS YUANSHENG OPTOELECTRONICS CO., LTD., Ordos, Inner Mongolia (CN)

(72) Inventors: Chenggeng Zhang, Beijing (CN); Boya Zhang, Beijing (CN)

(73) Assignees: BOE TECHNOLOGY GROUP CO., LTD., Beijing (CN); ORDOS YUANSHENG OPTOELECTRONICS CO., LTD., Ordos, Inner Monogolia (CN)

( * ) Notice: Subject to any disclaimer, the term of this patent is extended or adjusted under 35 U.S.C. 154(b) by 0 days.

(21) Appl. No.: 15/141,328

(22) Filed: Apr. 28, 2016

(65) Prior Publication Data

US 2016/0379554 A1 Dec. 29, 2016

(30) Foreign Application Priority Data

Jun. 23, 2015 (CN) ..... 2015 1 0350167

(51) Int. Cl.
*G09G 3/30* (2006.01)
*G09G 3/3208* (2016.01)

(52) U.S. Cl.
CPC ..... *G09G 3/3208* (2013.01); *G09G 2320/029* (2013.01); *G09G 2320/0626* (2013.01); *G09G 2330/028* (2013.01)

(58) Field of Classification Search
CPC ..... G09G 3/3208; G09G 2320/0295; G09G 2320/0626; G09G 2330/021
See application file for complete search history.

(56) References Cited

U.S. PATENT DOCUMENTS 8,143,800 B2 * 3/2012 Liu ..... H02M 1/4258 315/219
2002/0105279 A1 * 8/2002 Kimura ..... G09G 3/14 315/169.3

(Continued)

FOREIGN PATENT DOCUMENTS

CN 101340760 A 1/2009
CN 101989402 A 3/2011

(Continued)

OTHER PUBLICATIONS

First Office Action dated Dec. 28, 2016 in corresponding Chinese Application No. 201510350167.5.

(Continued)

*Primary Examiner* — Alexander H Taningco
*Assistant Examiner* — Kurtis R Bahr
(74) *Attorney, Agent, or Firm* — Nath, Goldberg & Meyer; Joshua B. Goldberg; Stanley N. Protigal

(57) ABSTRACT

The present invention provides a power supply circuit and an OLED display device, belongs to the field of OLED display technology, and can solve the problem that existing power supply circuits have low efficiency when brightness of the OLED display panel is low. The power supply circuit is used for proving an anode voltage and a cathode voltage for an OLED display panel, a difference between the anode voltage and the cathode voltage being a driving voltage, and the power supply circuit includes: a current detection unit for generating a control signal according to a driving current of the OLED display panel; and a driving voltage unit for generating, according to the control signal, a driving voltage positively correlated with the driving current, and including an anode voltage unit for generating an anode voltage and a cathode voltage unit for generating a cathode voltage.

12 Claims, 2 Drawing Sheets

(56) References Cited

U.S. PATENT DOCUMENTS

| | | | | |
|---|---|---|---|---|
| 2008/0042628 | A1* | 2/2008 | Wang | H02M 1/08 323/271 |
| 2008/0266216 | A1* | 10/2008 | Choi | G09G 3/3258 345/77 |
| 2010/0109537 | A1* | 5/2010 | Nishino | H05B 33/0827 315/185 R |
| 2012/0043902 | A1* | 2/2012 | Kanamori | H05B 33/0815 315/223 |
| 2012/0327066 | A1* | 12/2012 | Kato | G09G 3/3225 345/212 |
| 2013/0038591 | A1* | 2/2013 | Yang | G09G 3/34 345/211 |
| 2015/0124003 | A1* | 5/2015 | Mio | G09G 3/3406 345/690 |

FOREIGN PATENT DOCUMENTS

| | | | |
|---|---|---|---|
| CN | 102118905 | A | 7/2011 |
| CN | 103151009 | A | 6/2013 |
| CN | 103715889 | A | 4/2014 |
| CN | 104361859 | A | 2/2015 |

OTHER PUBLICATIONS

The Second Office Action dated May 17, 2017 corresponding to Chinese No. 201510350167.5.

* cited by examiner

Buck-Boost circuit

POWER SUPPLY CIRCUIT AND ORGANIC LIGHT-EMITTING DIODE DISPLAY DEVICE

CROSS-REFERENCE TO RELATED APPLICATION

This application claims priority to Chinese Patent Application No. 201510350167.5, filed on Jun. 23, 2015, the contents of which are incorporated by reference in the entirety.

FIELD OF THE INVENTION

The present invention relates to the field of organic light-emitting diode display technology, in particular to a power supply circuit and an organic light-emitting diode display device including the power supply circuit.

BACKGROUND OF THE INVENTION

An organic light-emitting diode (OLED) display panel achieves the display function by means of OLEDs in respective sub-pixels. An anode and a cathode of each OLED are respectively connected to an anode voltage and a cathode voltage, a difference between the anode voltage and the cathode voltage being a driving voltage, and the larger the brightness of the OLED is, the higher driving voltage is required. In the prior art, the driving voltage for an OLED display panel is provided by a power supply circuit and remains unchanged during display. If the driving voltage needs to be changed, it needs to be reset after the OLED display panel is turned off. Power consumption of the OLED display panel includes two parts, namely, power consumption caused by driving the OLEDs to emit light and power consumption caused by drive transistors of the respective sub-pixels, and the latter power consumption increases with an increase in the driving voltage.

Since the driving voltage remains unchanged, the driving voltage has to be higher than a voltage required for driving the OLEDs to reach the maximum brightness, in order to ensure that the OLEDs can reach the maximum brightness thereof. In this way, when an OLED has a relatively low brightness, the driving voltage is far higher than the voltage required for driving the OLED, thus, most of the power consumption of the drive transistors is unnecessary, as a result, useless power consumption is large and the power supply circuit has low efficiency.

SUMMARY OF THE INVENTION

An object of the present invention is to provide a power supply circuit that can maintain a relatively high efficiency in various situations and an OLED display panel including the power supply circuit, in view of the problem that the existing power supply circuit has low efficiency when an OLED display panel has a low brightness.

According to one aspect of the present invention, there is provided a power supply circuit for proving an anode voltage and a cathode voltage for an OLED display panel, a difference between the anode voltage and the cathode voltage being a driving voltage, and the power supply circuit including:

a current detection unit, which is used for generating a control signal according to a driving current of the OLED display panel; and a driving voltage unit, which is used for generating, according to the control signal, a driving voltage positively correlated with the driving current, and includes an anode voltage unit for generating an anode voltage and a cathode voltage unit for generating a cathode voltage.

Optionally, the current detection unit is connected to the cathode voltage unit, and the cathode voltage generated by the cathode voltage unit is negatively correlated with the driving current.

Optionally, the cathode voltage unit includes: a cathode pulse width modulation module connected to the current detection unit and used for generating a cathode pulse signal whose duty ratio is positively correlated with the driving current, and a cathode voltage regulation circuit used for generating a cathode voltage negatively correlated with the duty ratio of the cathode pulse signal.

Optionally, the cathode voltage regulation circuit is a Buck-Boost circuit.

Optionally, the cathode pulse width modulation module includes: an oscillation wave circuit used for generating a periodic oscillation wave; and a comparison circuit connected to an output terminal of the oscillation wave circuit and used for generating a high level of the cathode pulse signal when a voltage of the oscillation wave is higher than a reference voltage and generating a zero level of the cathode pulse signal when the voltage of the oscillation wave is lower than the reference voltage; the control signal generated by the current detection unit is the reference voltage, and the reference voltage being negatively correlated with the driving current.

Further optionally, the duty ratio of the cathode pulse signal generated by the cathode pulse width modulation module is controlled between 50% and 90%.

Optionally, the current detection unit includes: a light-emitting diode, through which the driving current flows; and a phototransistor capable of being irradiated by light emitted by the light-emitting diode, wherein a source of the phototransistor is connected to a first voltage terminal, a drain thereof is connected to a second voltage terminal, a first resistor is connected in series between the source and the first voltage terminal, and an end of the first resistor close to the phototransistor is an output terminal of the current detection unit.

Further optionally, the oscillation wave circuit is a triangular wave circuit used for generating a periodic triangular wave.

Optionally, the comparison circuit includes: a comparator whose non-inverting input terminal is connected to the reference voltage and whose inverting input terminal is connected to the output terminal of the oscillation wave circuit; and a Zener diode whose cathode is connected to an output terminal of the comparator and whose anode is connected to an output terminal of the comparison circuit.

Optionally, the current detection unit is connected to the anode voltage unit, and the anode voltage generated by the anode voltage unit is positively correlated with the driving current.

According to another aspect of the present invention, there is provided an OLED display device, including:

an OLED display panel used for display; and any one of the above power supply circuits used for providing a driving voltage for the OLED display panel.

In the context of the present disclosure, "A being positively correlated with B" means that A increases as B increases, and decreases as B decreases, i.e., A and B vary in the "same direction"; however, it neither represent that A has linear relation with B, nor represents that there is a specific relation between absolute values of A and B.

Similarly, "A being negatively correlated with B" means that A decreases as B increases, and increases as B decreases, i.e., A and B vary in "opposite directions".

The "pulse signal" is such a signal that the level thereof varies between zero level and high level periodically and alternately, and percentage of duration of the high level occupied in one cycle is the duty ratio.

The "oscillation wave" indicates that the level of the wave varies repeatedly in a manner of "gradual rising-gradual dropping" during a certain period, without varying suddenly or jumping.

Brightness of an OLED is positively correlated with a current flowing therethrough, the power supply circuit of the present disclosure includes the current detection unit capable of detecting a driving current of the OLED display panel (i.e., the sum of currents of all OLEDs), and a driving voltage generated by the driving voltage unit is positively correlated with the driving current, i.e., the driving voltage increases as the driving current increases, and decreases as the driving current decreases, so that the driving voltage can be lowered as much as possible while ensuring that the driving voltage can satisfy current brightness requirements, thereby reducing useless power consumption and improving efficiency of the power supply circuit.

DESCRIPTION OF THE PREFERRED EMBODIMENT

Figure 1:
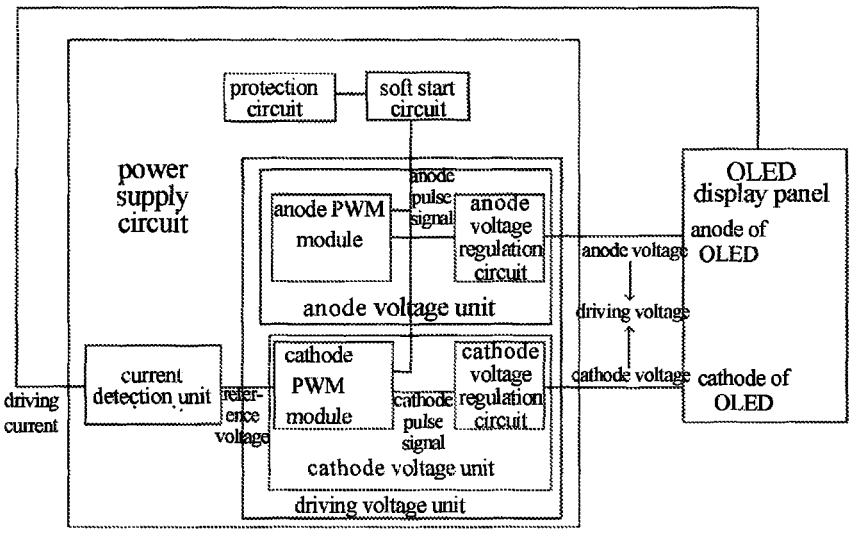
FIG. 1 is a schematic block diagram of a power supply circuit according to an embodiment of the present invention.

To enable those skilled in the art to better understand the technical solutions of the present invention, the present invention will be further described in detail below in conjunction with the accompanying drawings and the specific implementations.

Embodiments of the present invention provide a power supply circuit for proving an anode voltage and a cathode voltage for an OLED display panel, and a difference between the anode voltage and the cathode voltage is a driving voltage. As shown in FIGS. 1 to 4, the power supply circuit includes:

a current detection unit, which is used for generating a control signal according to a driving current of the OLED display panel; and a driving voltage unit, which is used for generating, according to the control signal, a driving voltage positively correlated with the driving current, and includes an anode voltage unit for generating an anode voltage and a cathode voltage unit for generating a cathode voltage.

The power supply circuit provided by the embodiments of the present invention is used for providing a driving voltage for the OLED display panel, i.e., providing an anode voltage (Vdd) to anodes of respective OLEDs in the OLED display panel and proving a cathode voltage (Vss) to cathodes thereof, so that the OLEDs can work normally.

In an OLED, its brightness is positively correlated with a current flowing therethrough, i.e., the larger the current, the greater the brightness, and the smaller the current, the lower the brightness. The power supply circuit provided by the embodiments of the present invention includes the current detection unit capable of detecting a driving current of the OLED display panel (i.e., the sum of currents of all OLEDs), and a driving voltage generated by the driving voltage unit is positively correlated with the driving current, i.e., the driving voltage increases as the driving current increases, and decreases as the driving current decreases, so that the driving voltage can be lowered as much as possible while ensuring that the driving voltage can satisfy current brightness requirements, thereby reducing useless power consumption and improving efficiency of the power supply circuit.

It should be noted that, the driving current is the sum of currents of all OLEDs in the OLED display panel, instead of the current of a single OLED, but due to the integrity of a display image, the OLEDs generally have low brightness when the driving current is small, and thus, by regulating the driving voltage in the manner as described above, the overall display effect will not be influenced.

As one implementation of the embodiments, the current detection unit is connected to the cathode voltage unit, and the cathode voltage is negatively correlated with the driving current.

That is to say, the driving voltage may be controlled by regulating the cathode voltage, in other words, the cathode voltage decreases as the driving current increases (and thus they are negatively correlated), and since the driving voltage is equal to a value obtained by subtracting the cathode voltage from the anode voltage, reducing the cathode voltage is equivalent to increasing the driving voltage. The reason for using this solution is that the voltage (anode voltage) of the anode of an OLED is generally fixed, and if the driving voltage needs to be changed, the cathode voltage is generally changed.

In this case, the cathode voltage unit may include:

a cathode pulse width modulation module connected to the current detection unit, the cathode pulse width modulation being used for generating a cathode pulse signal whose duty ratio is positively correlated with the driving current; and a cathode voltage regulation circuit used for generating a cathode voltage negatively correlated with the duty ratio of the cathode pulse signal. Preferably, the cathode voltage regulation circuit is a Buck-Boost circuit.

That is to say, as shown in FIG. 1, the duty ratio of the cathode pulse signal outputted by the cathode pulse width modulation module may be controlled according to the control signal generated by the current detection unit, and the cathode voltage is then controlled according to the duty ratio of the cathode pulse signal. The pulse width modulation module is also referred to as PWM module and can output a periodic square wave pulse signal, and the cathode voltage regulation circuit can convert the foregoing pulse signal into stable voltage output.

Specifically, the cathode voltage regulation circuit may be a Buck-Boost circuit, which is a known circuit and can convert a pulse signal into a constant voltage signal, the absolute value of the outputted voltage decreases as the duty ratio of the inputted pulse signal increases, in a case where a negative voltage is provided, larger absolute value of the negative voltage means smaller actual voltage, and it can thus be achieved that the cathode voltage is negatively correlated with the duty ratio of the inputted pulse signal.

Figure 2:
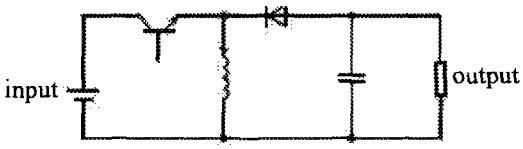
FIG. 2 is a circuit diagram of a Buck-Boost circuit in a power supply circuit according to an embodiment of the present invention.

Specifically, the Buck-Boost circuit may be considered to be formed by connecting a Buck Chopper circuit and a Boost Chopper circuit in series, the specific circuit thereof may be various, for example, the circuit shown in FIG. 2 may be adopted, and thus it is not described in detail herein.

Generally, the duty ratio of the cathode pulse signal suitable for the Buck-Boost circuit may be controlled between 50% and 90%.

In some embodiments of the present invention, the cathode pulse width modulation module may include:

an oscillation wave circuit for generating a periodic oscillation wave; and a comparison circuit connected to an output terminal of the oscillation wave circuit, the comparison circuit being used for generating a high level of the cathode pulse signal when a voltage of the oscillation wave is higher than a reference voltage and generating a zero level of the cathode pulse signal when the voltage of the oscillation wave is lower than or equal to the reference voltage. The reference voltage is the control signal generated by the current detection unit, and is negatively correlated with the driving current.

Figure 3:
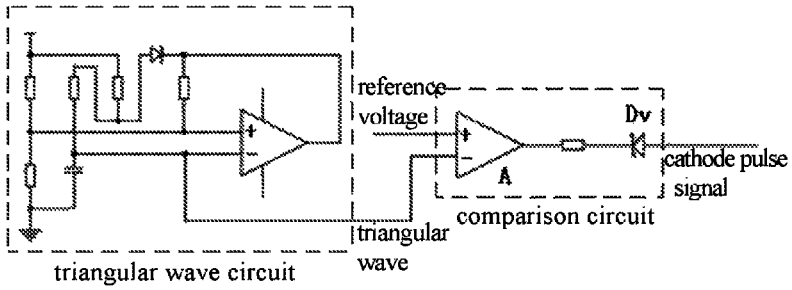
FIG. 3 is a circuit diagram of a cathode pulse width modulation module in a power supply circuit according to an embodiment of the present invention.

As shown in FIG. 3, the cathode pulse width modulation module may include the oscillation wave circuit capable of generating a periodic oscillation wave, and the oscillation wave generated by the oscillation wave circuit is then inputted into the comparison circuit, which generates a high level when the voltage of the oscillation wave is higher than the reference voltage and generates a zero level when the voltage of the oscillation wave is lower than or equal to the reference voltage. Thus, a ratio between parts of the oscillation wave higher than and lower than the reference voltage can be changed simply by adjusting the reference voltage, and a ratio between the outputted high level and the outputted zero level is thus changed, i.e., the duty ratio of the cathode pulse signal is changed. Obviously, a percentage of the part of the oscillation wave higher than the reference voltage decreases (i.e., the duty ratio decreases) as the reference voltage increases, so that the reference voltage is negatively correlated with the duty ratio of the cathode pulse signal. Therefore, the function of regulating the driving voltage can be achieved as long as the current detection unit can convert the detected driving current into the reference voltage negatively correlated with the driving current.

In some embodiments, the oscillation wave circuit may be a triangular wave circuit used for generating a periodic triangular wave.

Obviously, the triangular wave has a linearly-changed waveform, therefore, when it is used in combination with the reference voltage to generate a pulse signal, the duty ratio of the obtained cathode pulse signal has linear relationship with the reference voltage and thus can be controlled easily.

Specifically, a configuration of the triangular wave circuit may be as shown in FIG. 3, in which a comparator controls a capacitor to charge and discharge in different directions periodically, so as to generate a triangular wave. Since the triangular wave circuit is known, it is not described in detail herein. Moreover, the oscillation wave circuit may be other circuit capable of generating other oscillation wave, such as a sine wave circuit, etc., which is not described in detail herein.

The comparison circuit may include:

a comparator A whose non-inverting input terminal is connected to the reference voltage and whose inverting input terminal is connected to the output terminal of the oscillation wave circuit; and a Zener diode Dv whose anode is connected to an output terminal of the comparison circuit, and whose cathode is connected to an output terminal of the comparator A.

That is to say, the comparison circuit may include one comparator A, wherein the non-inverting input terminal of the comparator A is connected to the reference voltage, and the inverting input terminal of the comparator A is connected to the output terminal of the oscillation wave circuit (i.e., to the triangular wave), so as to achieve the above comparison function. In order to ensure stability of the outputted signal, the output terminal of the comparator A may be connected to the cathode of the Zener diode Dv, and the anode of the Zener diode Dv serves as the output terminal of the comparison circuit. Needless to say, the comparison circuit may further include other optional structure, such as a resistor provided between the Zener diode Dv and the comparator A, etc.

In some embodiments, the current detection unit may include:

a light-emitting diode LED, through which the driving current flows; and a phototransistor D1, which can be irradiated by light emitted by the light-emitting diode LED, wherein a source of the phototransistor D1 is connected to a first voltage terminal, a drain thereof is connected to a second voltage terminal, a first resistor is connected in series between the source and the first voltage terminal, and an end of the first resistor close to the phototransistor D1 is the output terminal of the current detection unit. Needless to say, a second resistor may be connected in series between the phototransistor D1 and the second voltage terminal, in order to adjust a voltage applied onto the phototransistor D1.

Figure 4:
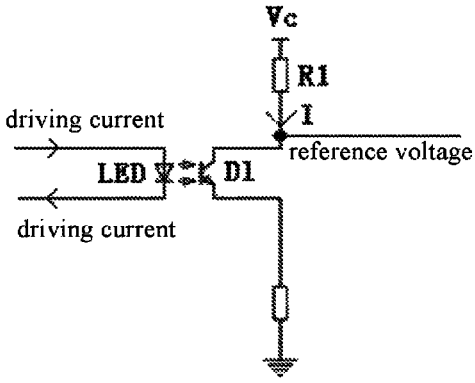
FIG. 4 is a circuit diagram of a current detection unit in a power supply circuit according to an embodiment of the present invention.

That is to say, as shown in FIG. 4, the current detection unit may convert the driving current into the reference voltage (control signal) in an electric-optic-electric conversion manner. Specifically, one light-emitting diode LED may be connected in series in a branch through which the driving current flows, thus luminous intensity of the light-emitting diode LED is positively correlated with the driving current, and needless to say, on-state voltage drop of the light-emitting diode LED should be as low as possible, so as to avoid the influence of the light-emitting diode itself on the driving current. Meanwhile, one phototransistor D1 is connected in series between the first voltage terminal and the second voltage terminal (e.g., a grounded terminal), and is located at a position that can be irradiated by light emitted by the light-emitting diode LED, and thus a current in the phototransistor D1 is positively correlated with the luminous intensity of the light-emitting diode LED. In this case, the reference voltage Vref may be calculated through the following formula: $Vref=(Vc-I*R1)$, where Vc is the voltage value of the first voltage terminal. I is the current flowing through the phototransistor D1, and R1 is the resistance value of the first resistor.

It can be seen that, when the driving current increases, the luminous intensity of the light-emitting diode LED increases, the current in the phototransistor D1 increases as well, and the reference voltage outputted by the current detection unit decreases, that is, the reference voltage is negatively correlated with the driving current. Further, because the reference voltage decreases, the percentage of the part of the oscillation wave whose voltage is higher than the reference voltage increases, the duty ratio of the cathode pulse signal is improved accordingly, and in a case where the cathode voltage is a negative voltage, the absolute value of the cathode voltage outputted by the cathode voltage regulation circuit increases, i.e., the actual value of the cathode voltage decreases. As a result, the difference between the anode voltage and the cathode voltage increases, and the finally obtained driving voltage increases, thereby achieving positive correlation between the driving voltage and the driving current.

The cathode voltage unit in the power supply circuit has been described in detail above, it should be understood that, the power supply circuit should also include the anode voltage unit for outputting a stable anode voltage, and the anode voltage unit may take any known form. For example, as shown in FIG. 1, the anode voltage unit may include an anode pulse width modulation module an anode voltage regulation circuit, and differs from the cathode voltage unit in that the anode pulse width modulation module in the anode voltage unit is not connected to the current detection unit and only needs to provide a stable anode pulse signal, and therefore the anode voltage finally outputted from the anode voltage unit is a stable high level. In the meanwhile, the power supply circuit may further include other known structures, such as a protection circuit having a protecting function, a soft start circuit for slightly staggering generation timing of the anode voltage and the cathode voltage at power on, which are not described in detail one by one.

As another implementation of the present invention, the current detection unit may be connected to the anode voltage unit, and the anode voltage is positively correlated with the driving current.

That is to say, the anode voltage may be controlled according to the driving current detected by the current detection unit, so as to achieve the purpose of adjusting the driving voltage. Since the anode voltage is positively correlated with the driving voltage, it should also be positively correlated with the driving current, so as to ensure that the driving voltage is positively correlated with the driving current.

Needless to say, the driving voltage may be adjusted in other manners, for example, in a manner in which the anode voltage and the cathode voltage are adjusted at the same time, which are not described one by one herein.

Embodiments of the present invention further provide an OLED display device, which includes:

an OLED display panel for display; and the above power supply circuit for providing a driving voltage for the OLED display panel.

In the OLED display device provided by the embodiments of the present invention, the OLED display panel is driven by the driving voltage provided by the above power supply circuit.

Specifically, the OLED display device may be any product or component having a display function, such as electronic paper, a mobile phone, a tablet computer, a television, a display, a notebook computer, a digital camera frame, a navigator, etc.

It could be understood that the foregoing implementations are merely exemplary implementations for describing the principle of the present invention, but the present invention is not limited thereto. A person of ordinary skill in the art may make various modifications and improvements without departing from the spirit and essence of the present invention, and these modifications and improvements shall fall into the protection scope of the present invention.

The invention claimed is:

1. A power supply circuit, for providing an anode voltage and a cathode voltage for an organic light-emitting diode display panel, a difference between the anode voltage and the cathode voltage being a driving voltage, wherein the power supply circuit comprises:

a current detection unit, which is used for generating a control signal according to a driving current of the organic light-emitting diode display panel; and a driving voltage unit, which is used for generating, according to the control signal, a driving voltage positively correlated with the driving current, and comprises an anode voltage unit for generating an anode voltage and a cathode voltage unit for generating a cathode voltage, and the current detection unit connected to only one of the anode voltage unit and the cathode voltage unit, wherein the current detection unit is connected to the cathode voltage unit, and the cathode voltage generated by the cathode voltage unit is negatively correlated with the driving current, wherein the cathode voltage unit comprises:

a cathode pulse width modulation module connected to the current detection unit, the cathode pulse width modulation module being used for generating a cathode pulse signal whose duty ratio is positively correlated with the driving current; and a cathode voltage regulation circuit used for generating a cathode voltage negatively correlated with the duty ratio of the cathode pulse signal, wherein the cathode pulse width modulation module comprises:

an oscillation wave circuit used for generating a periodic oscillation wave; and a comparison circuit connected to an output terminal of the oscillation wave circuit, the comparison circuit being used for generating a high level of the cathode pulse signal when a voltage of the oscillation wave is higher than a reference voltage and generating a zero level of the cathode pulse signal when the voltage of the oscillation wave is lower than the reference voltage, wherein the reference voltage is the control signal generated by the current detection unit and is negatively correlated with the driving current, and wherein the comparison circuit comprises:

a comparator whose non-inverting input terminal is connected to the reference voltage and whose inverting input terminal is connected to the output terminal of the oscillation wave circuit; and a Zener diode whose cathode is connected to an output terminal of the comparator and whose anode is connected to an output terminal of the comparison circuit.

2. The power supply circuit according to claim 1, wherein the cathode voltage regulation circuit is a Buck-Boost circuit.

3. The power supply circuit according to claim 1, wherein the duty ratio of the cathode pulse signal generated by the cathode pulse width modulation module is controlled between 50% and 90%.

4. The power supply circuit according to claim 1, wherein the current detection unit comprises:

a light-emitting diode, through which the driving current flows; and a phototransistor capable of being irradiated by light emitted by the light-emitting diode, wherein a source of the phototransistor is connected to a first voltage terminal, a drain thereof is connected to a second voltage terminal, a first resistor is connected in series between the source and the first voltage terminal, and an end of the first resistor close to the phototransistor is an output terminal of the current detection unit.

5. The power supply circuit according to claim 1, wherein the oscillation wave circuit is a triangular wave circuit used for generating a periodic triangular wave.

6. An organic light-emitting diode display device, comprising:

an organic light-emitting diode display panel used for display; and a power supply circuit used for providing an anode voltage and a cathode voltage for the organic light-emitting diode display panel, a difference between the anode voltage and the cathode voltage being a driving voltage, wherein the power supply circuit comprises:

a current detection unit, which is used for generating a control signal according to a driving current of the organic light-emitting diode display panel; and a driving voltage unit, which is used for generating, according to the control signal, a driving voltage positively correlated with the driving current, and comprises an anode voltage unit for generating an anode voltage and a cathode voltage unit for generating a cathode voltage, wherein the current detection unit is connected to the cathode voltage unit, and the cathode voltage generated by the cathode voltage unit is negatively correlated with the driving current, wherein the cathode voltage unit comprises:

a cathode pulse width modulation module connected to the current detection unit, the cathode pulse width modulation module being used for generating a cathode pulse signal whose duty ratio is positively correlated with the driving current; and a cathode voltage regulation circuit used for generating a cathode voltage negatively correlated with the duty ratio of the cathode pulse signal, wherein the cathode pulse width modulation module comprises:

an oscillation wave circuit used for generating a periodic oscillation wave; and a comparison circuit connected to an output terminal of the oscillation wave circuit, the comparison circuit being used for generating a high level of the cathode pulse signal when a voltage of the oscillation wave is higher than a reference voltage and generating a zero level of the cathode pulse signal when the voltage of the oscillation wave is lower than the reference voltage, wherein the reference voltage is the control signal generated by the current detection unit and is negatively correlated with the driving current, wherein the comparison circuit comprises:

a comparator whose non-inverting input terminal is connected to the reference voltage and whose inverting input terminal is connected to the output terminal of the oscillation wave circuit; and a Zener diode whose cathode is connected to an output terminal of the comparator and whose anode is connected to an output terminal of the comparison circuit.

7. The organic light-emitting diode display device according to claim 6, comprising:

the current detection unit connected to only one of the anode voltage unit and the cathode voltage unit.

8. The organic light-emitting diode display device according to claim 6, wherein the cathode voltage regulation circuit is a Buck-Boost circuit.

9. The organic light-emitting diode display device according to claim 6, wherein the duty ratio of the cathode pulse signal generated by the cathode pulse width modulation module is controlled between 50% and 90%.

10. The organic light-emitting diode display device according to claim 6, wherein the current detection unit comprises:

a light-emitting diode, through which the driving current flows; and a phototransistor capable of being irradiated by light emitted by the light-emitting diode, wherein a source of the phototransistor is connected to a first voltage terminal, a drain thereof is connected to a second voltage terminal, a first resistor is connected in series between the source and the first voltage terminal, and an end of the first resistor close to the phototransistor is an output terminal of the current detection unit.

11. The organic light-emitting diode display device according to claim 6, wherein the oscillation wave circuit is a triangular wave circuit used for generating a periodic triangular wave.

12. The organic light-emitting diode display device according to claim 6, wherein the current detection unit is connected to the anode voltage unit, and the anode voltage generated by the anode voltage unit is positively correlated with the driving current.

* * * * *